US008864334B2

(12) United States Patent
Swafford, Jr. et al.

(10) Patent No.: US 8,864,334 B2
(45) **Date of Patent: *Oct. 21, 2014**

(54) LED LIGHTING ASSEMBLY AND METHOD OF LIGHTING FOR A MERCHANDISE DISPLAY

(75) Inventors: John Wesley Swafford, Jr., Palatine, IL (US); David S. Breslow, Chicago, IL (US); Joseph Christian Ernest, Woodstock, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 249 days.

This patent is subject to a terminal disclaimer.

(21) Appl. No.: 12/955,198

(22) Filed: Nov. 29, 2010

(65) Prior Publication Data

US 2011/0063844 A1 Mar. 17, 2011

(51) Int. Cl.

| | |
|---|---|
| ***F21V 5/00*** | (2006.01) |
| ***A47B 23/06*** | (2006.01) |
| ***F21V 1/00*** | (2006.01) |
| ***F21V 21/30*** | (2006.01) |
| ***F21V 5/04*** | (2006.01) |
| ***F21V 17/06*** | (2006.01) |
| ***F21S 4/00*** | (2006.01) |
| ***A47F 11/10*** | (2006.01) |
| *F21W 131/405* | (2006.01) |
| *F21Y 101/02* | (2006.01) |
| *F21V 17/16* | (2006.01) |

(52) U.S. Cl.

CPC ..... *F21V 21/30* (2013.01); *F21W 2131/405* (2013.01); *F21Y 2101/02* (2013.01); *F21V 5/04* (2013.01); *F21V 17/06* (2013.01); *F21S 4/008* (2013.01); *F21V 17/164* (2013.01); *A47F 11/10* (2013.01)

USPC ..... 362/244; 362/133; 362/217.01

(58) Field of Classification Search

CPC ..... F21S 4/008; F21S 4/003; F21V 5/04; F21V 15/013; F21V 5/007; F21V 21/005; F21K 9/00; G02B 19/0028; G02B 19/0066

USPC ..... 362/133, 125, 126

See application file for complete search history.

(56) References Cited

U.S. PATENT DOCUMENTS

| | | | | |
|---|---|---|---|---|
| 6,188,527 | B1 | 2/2001 | Bohn | |
| 6,283,612 | B1 | 9/2001 | Hunter | |
| D464,162 | S | 10/2002 | Segretto | |
| 6,502,956 | B1 * | 1/2003 | Wu | 362/237 |
| 6,536,924 | B2 | 3/2003 | Segretto | |
| 6,736,525 | B2 | 5/2004 | Chin | |
| 6,773,139 | B2 * | 8/2004 | Sommers | 362/237 |
| D496,122 | S | 9/2004 | Kan | |
| D506,274 | S | 6/2005 | Moriyama et al. | |
| 6,995,405 | B2 | 2/2006 | Braddell et al. | |

(Continued)

*Primary Examiner* — David J Makiya

(74) *Attorney, Agent, or Firm* — Banner & Witcoff, Ltd.

(57) ABSTRACT

Aspects of the disclosure relate to a lighting assembly and method for illuminating a vertical planar area, such as a merchandise display. The lighting assembly can comprise a circuit board having a plurality of LEDs arranged in a substantially straight line and an LED driver circuit, and an integral lens assembly. The integral lens assembly can have a plurality of lenses and each of the plurality of lenses can be placed over a corresponding one of the plurality of LEDs. The lenses capture the light from the respective LED, modify its beam pattern, and re-project the light such that the light emitted from the lighting assembly is distributed substantially evenly in a vertical plane or direction.

17 Claims, 4 Drawing Sheets

(56) References Cited

U.S. PATENT DOCUMENTS

| | | | | |
|---|---|---|---|---|
| 6,997,576 | B1 | 2/2006 | Lodhie et al. | |
| D546,985 | S | 7/2007 | Hoshikawa et al. | |
| D550,379 | S | 9/2007 | Hoshikawa et al. | |
| D550,869 | S | 9/2007 | Hoshikawa et al. | |
| D565,515 | S | 4/2008 | Chen | |
| D568,500 | S | 5/2008 | Uemoto et al. | |
| D571,938 | S | 6/2008 | Uemoto et al. | |
| D578,681 | S | 10/2008 | Huang | |
| D579,138 | S | 10/2008 | Ghini | |
| 7,441,922 | B2 | 10/2008 | Huang et al. | |
| D581,569 | S | 11/2008 | Levine | |
| D595,444 | S | 6/2009 | Shimomura | |
| D603,079 | S | 10/2009 | Toot et al. | |
| D606,673 | S | 12/2009 | Kao | |
| 7,633,684 | B1 | 12/2009 | Lo | |
| 7,648,251 | B2 | 1/2010 | Whitehouse et al. | |
| 7,674,010 | B2 * | 3/2010 | Griffiths et al. | 362/249.02 |
| D614,323 | S | 4/2010 | Stewart et al. | |
| D615,223 | S | 5/2010 | Huang | |
| 7,722,221 | B2 | 5/2010 | Chae | |
| 7,810,951 | B1 * | 10/2010 | Lee et al. | 362/249.03 |
| 7,824,057 | B2 * | 11/2010 | Shibusawa et al. | 362/125 |
| 7,896,521 | B2 * | 3/2011 | Becker et al. | 362/244 |
| 8,066,406 | B2 * | 11/2011 | Boyer et al. | 362/249.02 |
| 8,070,329 | B1 * | 12/2011 | Bechtel et al. | 362/331 |
| 8,215,795 | B2 * | 7/2012 | Pichel | 362/249.02 |
| 2002/0044456 | A1 * | 4/2002 | Balestriero et al. | 362/555 |
| 2005/0265019 | A1 | 12/2005 | Sommers et al. | |
| 2006/0146531 | A1 * | 7/2006 | Reo et al. | 362/244 |
| 2008/0062691 | A1 * | 3/2008 | Villard et al. | 362/252 |
| 2008/0094824 | A1 * | 4/2008 | Stack et al. | 362/125 |
| 2008/0094837 | A1 | 4/2008 | Dobbins et al. | |
| 2008/0298058 | A1 * | 12/2008 | Kan et al. | 362/240 |
| 2009/0103299 | A1 | 4/2009 | Boyer et al. | |
| 2009/0207602 | A1 * | 8/2009 | Reed et al. | 362/225 |
| 2009/0225543 | A1 * | 9/2009 | Jacobson et al. | 362/247 |
| 2009/0323330 | A1 * | 12/2009 | Gordin et al. | 362/235 |
| 2010/0110660 | A1 * | 5/2010 | Brukilacchio | 362/84 |
| 2010/0254138 | A1 * | 10/2010 | Chen et al. | 362/236 |
| 2011/0063857 | A1 * | 3/2011 | Li et al. | 362/336 |

* cited by examiner

LED LIGHTING ASSEMBLY AND METHOD OF LIGHTING FOR A MERCHANDISE DISPLAY

FIELD OF INVENTION

This invention relates generally to LED lighting assemblies for a merchandise display and methods of lighting. In particular, in one aspect of the invention, an LED light assembly is provided with various lenses to capture the light from LED emitters so as to modify their beam patterns, and re-project the light to provide an even distribution of the light in a vertical plane.

BACKGROUND

In many retail stores it is desired to illuminate the front of product packages on merchandise display shelves to improve the product presentation, shopping environment, and to highlight products to ultimately improve the overall sales of the products.

Typically, this is accomplished with a fluorescent lighting fixture, which is located above a shelving unit and emits light down upon the front of the shelves. However, in most existing installations of this type, much of the light is not used because it is not captured and directed to the front of the shelves. Lack of focusing, specific reflectors, or beam modification results in product on higher shelves being too brightly illuminated and product on lower shelves receiving very little light at all.

Additionally, there are also significant costs with replacing lamps on fluorescent fixtures when they deteriorate or burn out including the costs of new lamps and labor to replace the lamps. In addition, when the lamps are replaced on the scale of a large retail chain, replacement can become environmentally harmful since all fluorescent lamps contain mercury.

In one exemplary aspect of the present invention, more of the available light is directed to the front of products merchandised on a shelf and a higher illuminance per watt of power is output than with existing fluorescent fixtures. In another exemplary aspect of the present invention, a lower cost lighting solution is disclosed that uses less energy, directs and improves the illumination on the product packages, particularly on the lower shelves, and requires lower maintenance costs.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In one exemplary embodiment, a lighting assembly for a merchandise display is disclosed. The lighting assembly can comprise a circuit board assembly having a plurality of LEDs and an LED driver circuit and an integral lens assembly. The integral lens assembly can comprise a plurality of lenses. The plurality of lenses can be placed over a corresponding one of the plurality of LEDs allowing the lenses to capture the light from a respective LED, modify the beam pattern, and re-project the light.

In another exemplary embodiment, a lighting method for a merchandise display is disclosed. The method can comprise arranging a plurality of LEDs and a LED driver circuit on a circuit board and, securing a plurality of lenses to the circuit board, placing the plurality of lenses over a corresponding one of the plurality of LEDs so as to capture the light from a respective LED, modify a beam pattern emitted from the respective LED, and re-project the light emitted from the respective LED.

Other objects and features of the invention will become apparent by reference to the following description and drawings.

BRIEF DESCRIPTION OF THE DRAWINGS

A more complete understanding of the present invention and certain advantages thereof may be acquired by referring to the following detailed description in consideration with the accompanying drawings, in which.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized, and structural and functional modifications may be made without departing from the scope of the present invention. Also, while the terms "top" and "bottom" and the like may be used in this specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention.

Figure 1:
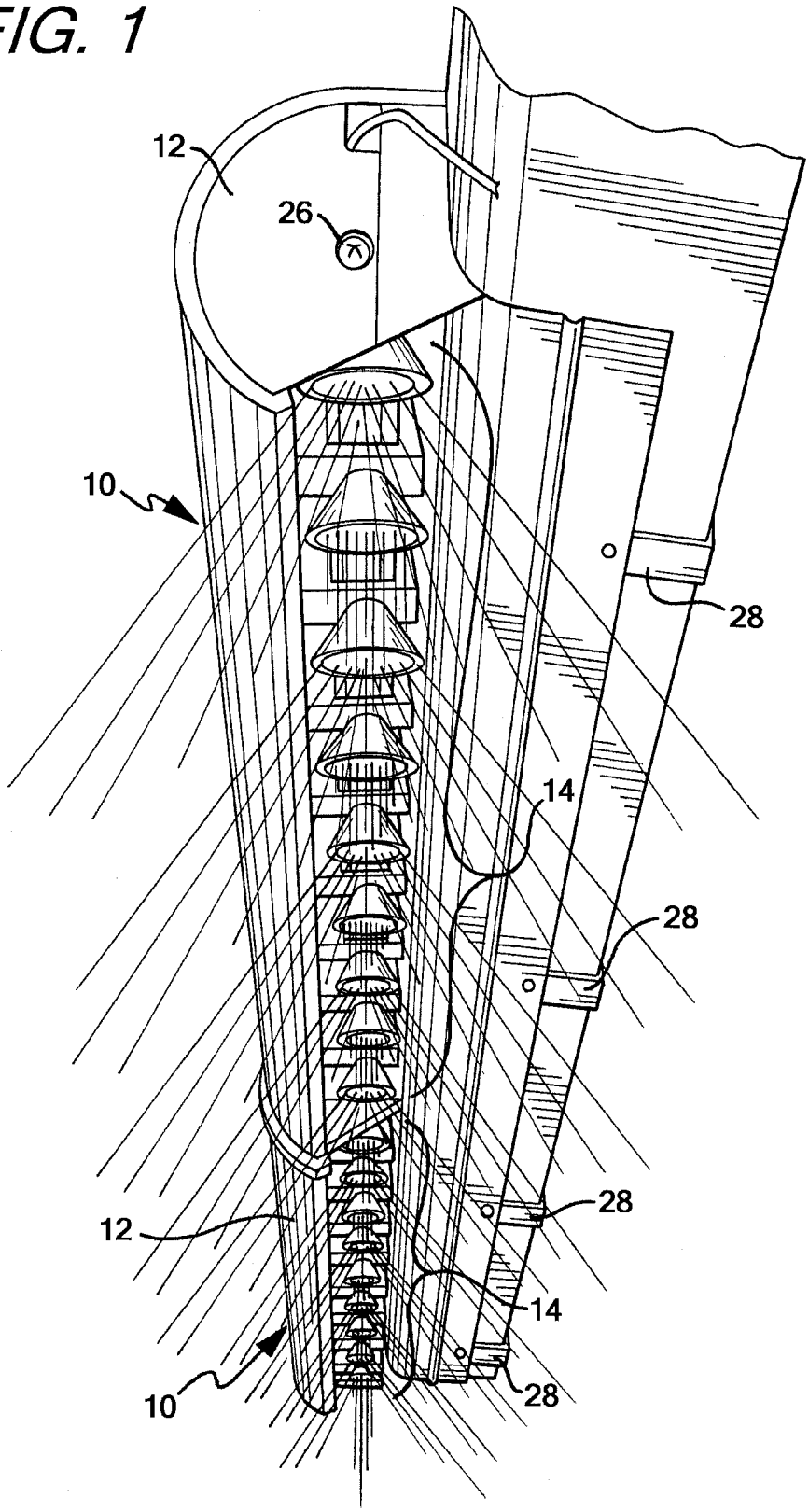
FIG. 1 shows a perspective view of exemplary lighting assemblies in use on a merchandise display.
Figure 2:
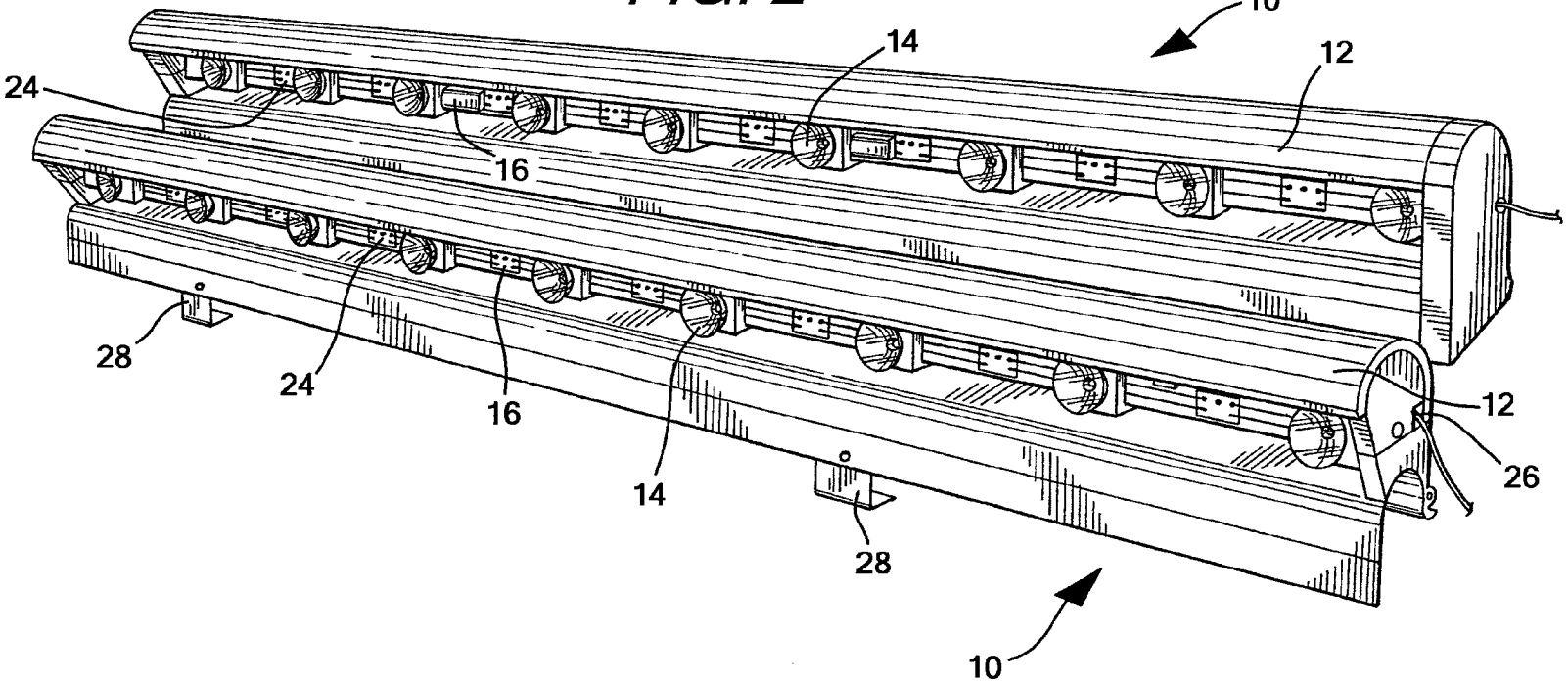
FIG. 2 shows another perspective view of exemplary lighting assemblies.
Figure 3B:
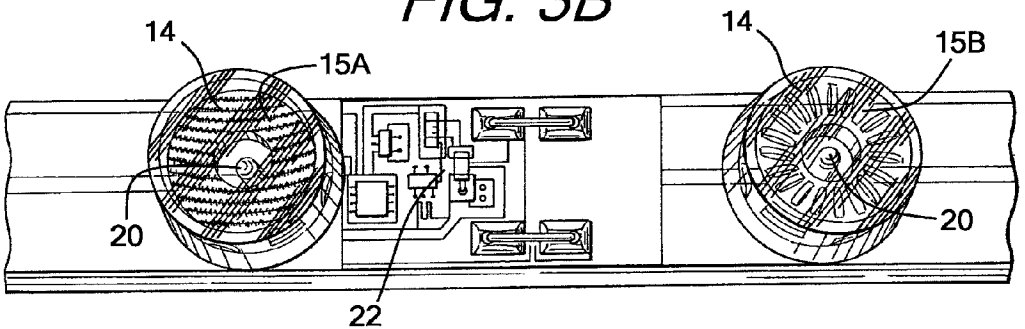
Figure 4:
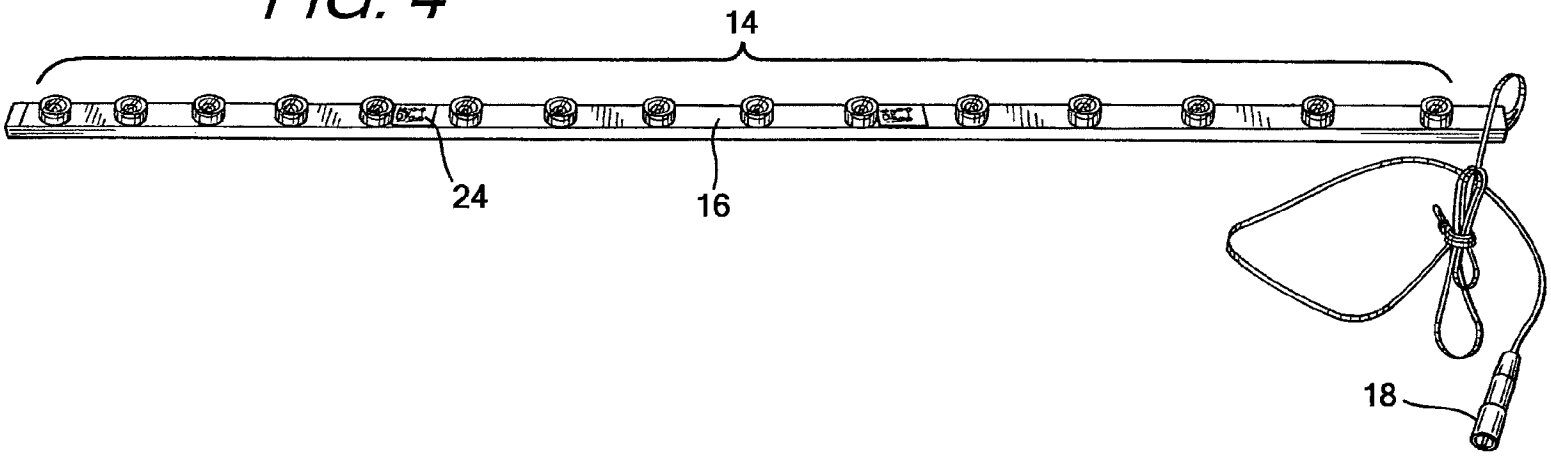
FIG. 4 shows a perspective view of the exemplary circuit board assembly.

FIGS. 1 and 2 depict exemplary LED lighting assemblies 10 for a merchandise display. As shown in FIGS. 1 and 2, the LED lighting assemblies 10 each include a housing 12, a circuit board assembly 24, and a circuit board 16 having an LED driver circuit 22 (shown in FIG. 3B). The housing 12 can include a series of clamps 28 for securing the housings above the area being illuminated. A plurality of LED emitters 20 are mounted to the circuit board 16 and are powered with the LED driver circuit 22. As shown in FIG. 4, the LEDs are spaced apart from each other along the circuit board assembly 24. The circuit board assembly 24 is also connected to a power cord 18.

Figure 3A:
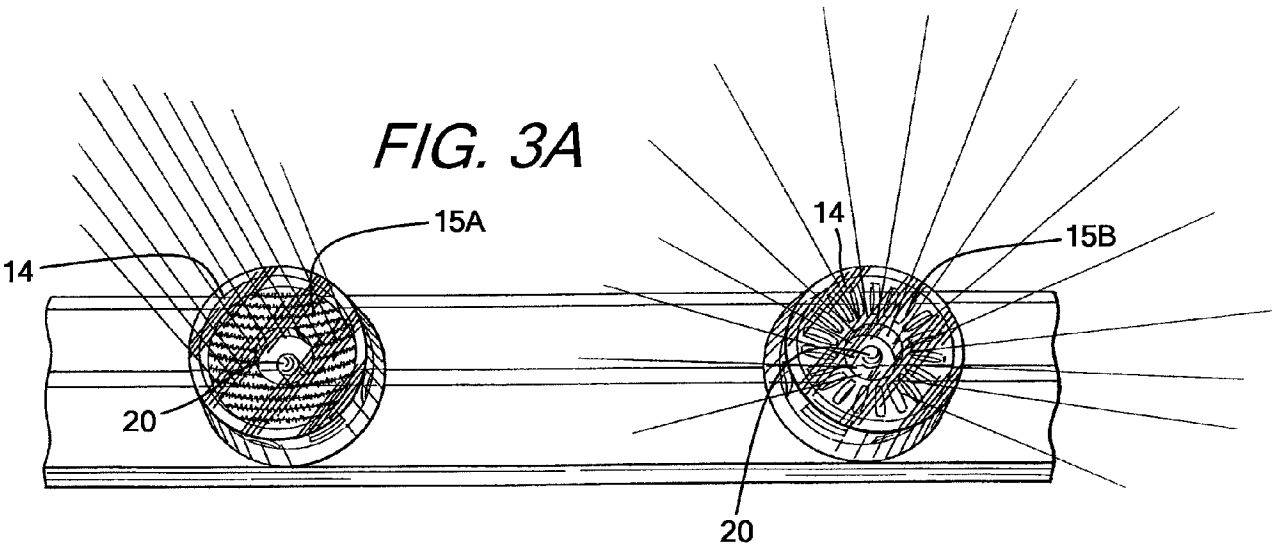
FIGS. 3A and 3B show top views of an exemplary circuit board assembly contained in the lighting assemblies.

The lenses 14 can be secured over individual LED emitters 20 to provide different refractive properties for reflecting the light emitted by the LEDs in various angles and directions such as over product shelves. As shown in FIGS. 3A and 3B, the lenses 14 can be provided with different refractive configurations. However, alternatively, the lenses can all be provided with the same refractive configurations. In another alternative embodiment, the lenses may be placed over ever other LED to modify the light pattern. Other arrangements are also contemplated to provide optimal lighting properties and configurations depending on the environment and desired results.

In one exemplary embodiment, as shown in FIGS. 3A and 3B, the lenses are provided with a spotlight beam refractive surface 15A and an oval beam refractive surface 15B. The light emitted from the spotlight pattern 15A lenses on the circuit board assembly 14 is directed at the lowest point such as a product on the bottom shelf, whereas the light emitted from the oval pattern 15B lenses is directed at the upper and middle areas such as at products on the top and middle shelves. When in use in the lighting assembly, the different refractive surfaces or lens types (spotlight pattern 15A and oval pattern 15B) project the light in various directions such that the individual patterns in aggregate from all LED emitters, result in light more evenly distributed in a vertical plane such as over products and shelves on display.

In one exemplary embodiment, the lens types can alternate on the circuit board assembly 24 between the spotlight pattern 15A configuration and the oval pattern 15B configuration. This embodiment may aid in providing an evenly distributed vertical lighting area such as over product shelves. In particular, the lighting pattern is narrower near the housing such as near the top shelves and grows wider as it travels down to the lower areas such as near the bottom shelves. Additionally, the light from the oval pattern 15B lenses overlaps to provide for more evenly lit areas.

Figure 5:
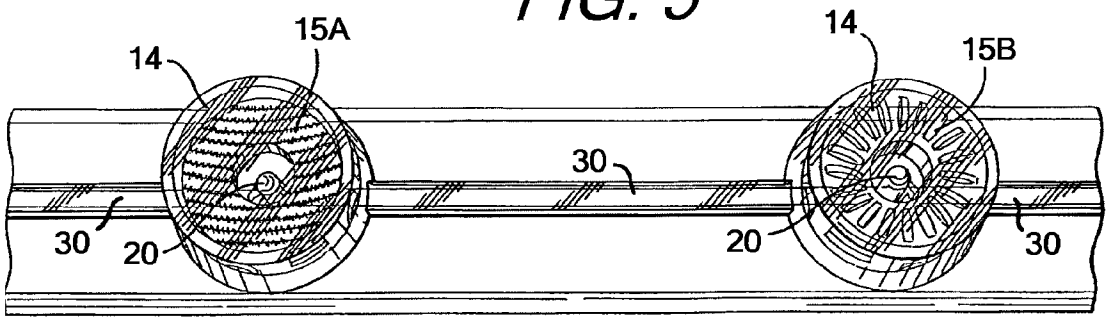
FIG. 5 shows a top view of another exemplary circuit board assembly contained in the lighting assemblies The reader is advised that the attached drawings are not necessarily drawn to scale.

The lenses 14 may be secured to the circuit board assembly 24 via a snap fit or by any other known suitable connection. As depicted in FIG. 5, the lenses may be fixed individually, for example, one lens per one LED or one or more lenses may be connected together via connection 30 to create a uniform, one-piece lens assembly that is easier, faster, and more cost effective to install on the circuit board assembly.

The LED lighting housing can be adjustable in several ways to adjust the orientation of the housing and to fine tune the position of the projected light. First, the housing can be adjusted on horizontal arms (not shown) that are generally perpendicular to the long edge of the shelves and positioned above the top shelf in a set of shelves. This adjustment allows the LED lighting assembly to be moved closer to or farther from the plane being illuminated. The second adjustment allows the assembly to rotate about its horizontal axis 26 to direct light at a different angle in the plane. The two adjustments change the angle at which the light intercepts the product faces. Moving the lighting fixture away from the product on the horizontal arms can improve the lighting on the lower positioned product by reducing shadows on the product caused by the lower shelves.

Each of the LED lighting assemblies 10 modify the light output from the point source LED emitters 20 to illuminate an artificial planar surface area which can be represented by a front surface of product on a shelf in a retail store. Each LED lighting assembly can be approximately the length of a shelf in a retail store, typically 3 ft or 4 ft long. The LED lighting assemblies 10 can be positioned in a horizontal orientation above a product on the top shelf and slightly in front of an artificial plane. The light is modified by the plurality of lenses 14 fitted onto the circuit board 16 and over the LEDs 20 to capture the light from an LED, modify the beam pattern, and re-project the light evenly over a vertical plane in front of the product shelves.

The modified light projected onto the products on the retail shelf is relatively consistent in brightness over the planar surface and adds sufficient relative brightness beyond the general store luminaire lighting to call attention to or highlight the product merchandised on the shelf. Also, the lensing technique directs the available LED light such that the lighting pattern produced on the planar surface and the product faces is far more homogenous than that of a fluorescent system. Top, center, and lower product on the shelves is relatively evenly illuminated providing the desired effect for the consumer shopper. The modified light projected onto the products may increase shopper awareness of the products, better present the products, and increase the sales of products.

By capturing and directing a higher percentage of total light output from the LEDs using appropriate lensing, the illuminance per watt can be higher than is generally possible with a fluorescent light, adding to a further reduction in necessary power input to achieve the desired lighting effect and energy savings.

The LED circuit board and housing is designed to be thermally efficient and to remove as much heat from the LED as possible. Projected life of the LEDs is on the order of 4-6 times than that of typical existing fluorescent lamps. This reduces service call frequency by four to five times and commensurate cost.

Cost savings from reduced energy use and fewer service calls, along with improved sales from better product presentation may offset the cost of replacing existing fluorescent fixtures with an LED lighting fixture.

The reader should understand that these specific examples are set forth merely to illustrate examples of the invention, and they should not be construed as limiting the invention. Many variations in the lighting assemblies may be made from the specific structures described above without departing from this invention.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A lighting assembly for a merchandise display comprising:

a circuit board assembly having a plurality of LEDs and an LED driver circuit, wherein the plurality of LEDs is arranged in a substantially straight line;

a lens assembly comprising a plurality of lenses arranged in linear array of a first lens type and a second lens type wherein the first lens type and the second lens type are placed over a corresponding one of the plurality of LEDs in an alternating pattern, and wherein the lenses are configured to capture the light from a respective LED, modify the beam pattern, and re-project the light from the plurality of LEDs in a plurality of lighting areas vertically arranged to form a vertical lighting area nearest the lighting assembly comprising a narrower lighting pattern than a lighting area further from the lighting assembly, such that a plurality of levels on the merchandise display are evenly illuminated by the lighting assembly mounted above the vertical lighting area.

2. The lighting assembly of claim 1 further comprising an adjustable housing configured to adjust the orientation of the circuit board assembly and wherein the lighting assembly is configured to be adjusted about its horizontal axis.

3. The lighting assembly of claim 1 wherein the first lens type provides a different beam pattern than the second lens type.

4. The lighting assembly of claim 1 wherein the plurality of lenses are snap-fit into place over the plurality of LEDs.

5. The lighting assembly of claim 1 wherein the plurality of lenses comprise configurations that produce a spotlight beam pattern and an oval shaped beam pattern.

6. The lighting assembly of claim 1 wherein the plurality of lenses are connected together to create a uniform, one-piece integral lens assembly.

7. A merchandise display lighting method comprising:

arranging a plurality of LEDs and a LED driver circuit on a circuit board, wherein the plurality of LEDs is arranged in a substantially straight line and;

securing a plurality of lenses to the circuit board in a linear array, the plurality of lenses comprising a first lens type and a second lens type;

placing the first lens type and the second lens type of the plurality of lenses over a corresponding one of the plurality of LEDs in an alternating configuration so as to capture the light from a respective LED, modify a beam pattern emitted from the respective LED, and re-project the light emitted from the respective LED, wherein the emitted light from the plurality of LEDs creates a plurality of substantially evenly illuminated levels extending vertically on the merchandise display.

8. The lighting method of claim 7 further comprising adjusting the beams with an adjustable housing.

9. The lighting method of claim 7 further comprising providing more than one configuration on the plurality of lenses to produce more than one beam pattern.

10. The lighting method of claim 7 further comprising snap-fitting the plurality of lenses into place over each of the plurality of LEDs.

11. The lighting method of claim 7 wherein the plurality of lenses are provided with configurations that produce a spotlight beam pattern and an oval shaped beam pattern.

12. The lighting method of claim 7 further comprising connecting the plurality of lenses together to create a uniform, one-piece lens assembly for placement onto the circuit board.

13. A lighting assembly for a merchandise display comprising:

a circuit board assembly having a plurality of LEDs arranged in a substantially straight line and an LED driver circuit;

an integral lens assembly fitting to the circuit board assembly, wherein the integral lens assembly comprises a plurality of lenses of a first lens type and a second lens type wherein each of the plurality of lenses are placed over a corresponding one of the plurality of LEDs in an alternating pattern and in a linear array, and wherein the lenses are configured to capture the light from a respective LED, modify the beam pattern, and re-project the light emitted from the plurality of LEDs in a plurality of lighting areas vertically arranged, such that the plurality of levels on the merchandise display are evenly illuminated by the lighting assembly by the lighting assembly mounted above the vertical lighting area;

and an adjustable housing configured to direct and aim light emitted from the LEDs, wherein the lighting assembly is configured to be adjusted about its horizontal axis.

14. The lighting assembly of claim 13 wherein the plurality of lenses comprise two different lens types and the two different lens types are placed over the LEDs in an alternating pattern.

15. The lighting assembly of claim 14 wherein the two different lens types comprise different configurations that produce a spotlight beam pattern and an oval shaped beam pattern.

16. The lighting assembly of claim 13 wherein the plurality of lenses are snap-fit into place over each of the plurality of LEDs.

17. The lighting assembly of claim 13 wherein the plurality of lenses are connected together to create a uniform, one-piece integral lens assembly.

* * * * *